United States Patent [19]

Cook

[11] Patent Number: 4,510,358

[45] Date of Patent: Apr. 9, 1985

[54] FLUID ACTUATED SWITCH

[75] Inventor: John Cook, Cottontown, Tenn.

[73] Assignees: J. W. Graves; Harold Tate, Jr., ; part interest to each

[21] Appl. No.: 562,062

[22] Filed: Dec. 16, 1983

[51] Int. Cl.[3] ..... H01H 35/24

[52] U.S. Cl. ..... 200/81 R; 200/81.9 R; 200/81.9 M

[58] Field of Search ..... 200/52 R, 61.45 R, 61.45 M, 200/61.48, 61.51, 81.9 R, 81.9 M, 81.4, 81 R

[56] References Cited

U.S. PATENT DOCUMENTS

| | | | |
|---|---|---|---|
| 2,147,949 | 2/1939 | Muller | 46/208 |
| 2,185,374 | 1/1940 | Hickman | 200/175 |
| 2,421,768 | 6/1947 | Voliazzo et al. | 200/81.9 R X |
| 2,556,813 | 9/1951 | Thorsen | 200/81.9 R |
| 2,600,011 | 6/1952 | MacDonald et al. | 200/81.9 M |
| 2,600,309 | 6/1952 | MacDonald et al. | 200/81.9 M |
| 3,479,561 | 11/1969 | Janning | 315/119 |
| 3,778,572 | 12/1973 | Matsui et al. | 200/61.45 M |
| 3,890,646 | 6/1975 | Fassett et al. | 2/8 |
| 3,946,174 | 3/1976 | Herbst | 200/81.4 |
| 4,275,391 | 6/1981 | Okamura | 200/61.45 M X |

FOREIGN PATENT DOCUMENTS

| | | | |
|---|---|---|---|
| 1241143 | 8/1960 | France | 200/81.9 M |

*Primary Examiner*—J. R. Scott

*Attorney, Agent, or Firm*—Finnegan, Henderson, Farabow, Garrett & Dunner

[57] ABSTRACT

A fluid actuated switch including a fluid responsive vane pivotally mounted within a fluid directing channel is provided. The vane oscillates a movable electrical contact between two spaced stationary electrical contacts opening a first electrical circuit and enclosing a second electrical circuit as it moves from one stationary contact to the other. An adjustable holding assembly is associated with the vane for holding the movable switch contact into engagement with the stationary contacts such that a predetermined fluid force is required to move the vane opening one of the circuits and closing the other of the circuits.

9 Claims, 2 Drawing Figures

Fig. 1
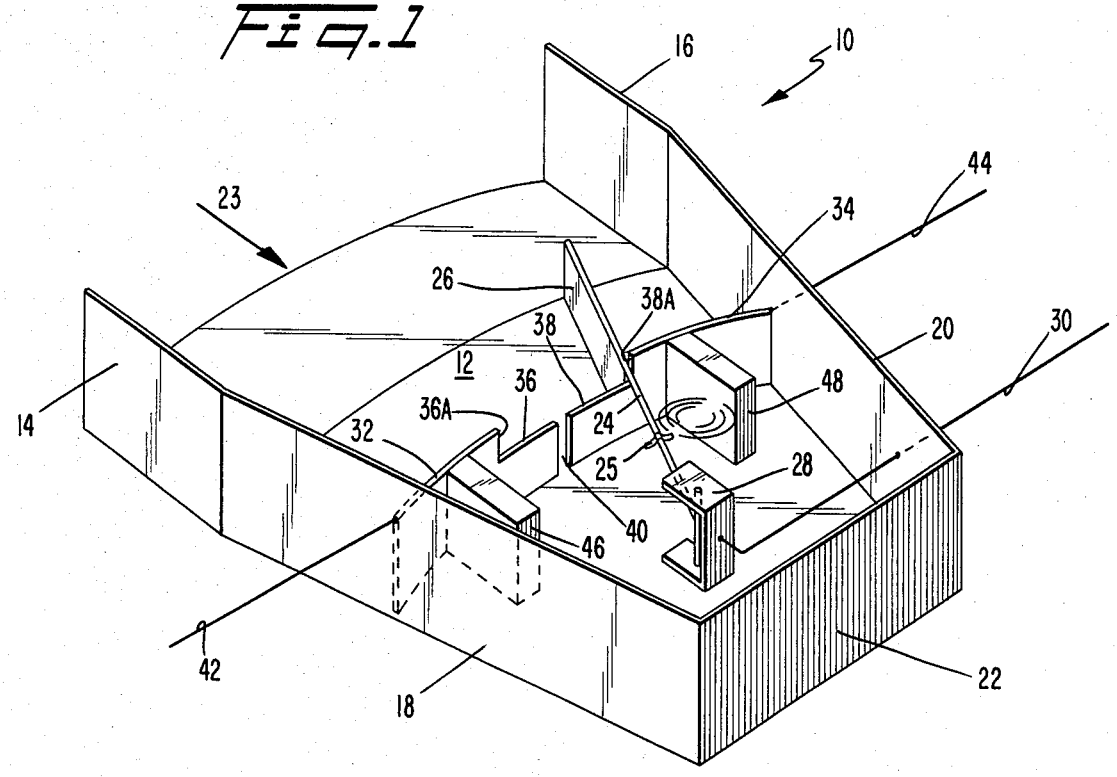
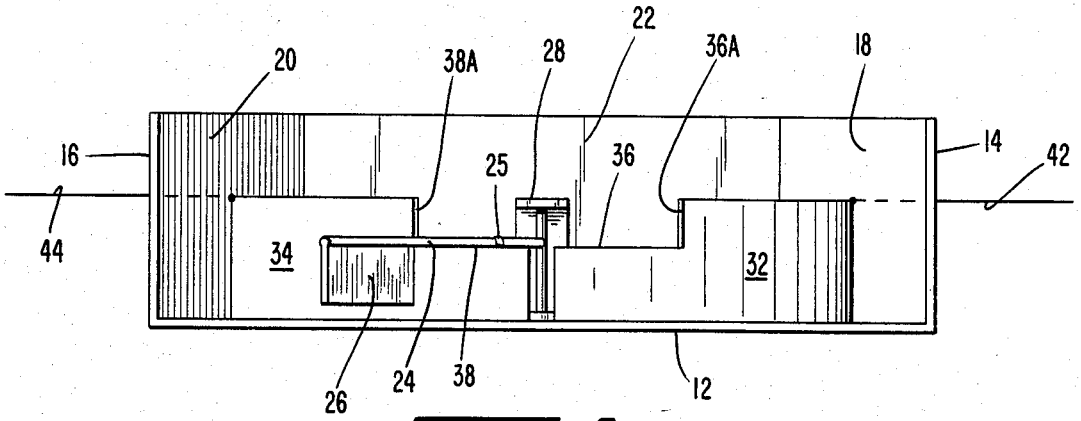
Fig. 2

FLUID ACTUATED SWITCH

BACKGROUND OF THE INVENTION

The present invention relates to a fluid actuated electrical switch making use of a fluid responsive vane to open and close respective electrical circuits. The vane actuates a movable switch contact to open and close the circuits as it pivots within a fluid receiving channel between stationary switch contacts. Magnets are provided within the channel for adjustably holding the movable switch contact closed with either of the stationary contacts. Adjustment of the magnetic holding force regulates sensitivity of the switch.

There are many situations where it is desirable for a person to be able to actuate a switch without using hands or a movement of limbs or other parts of the body. Specific examples of such situations include workers' controlling equipment while requiring freedom of hands in the performance of their duties and quadraplegics' controlling devices, such as wheelchairs, computers, and the like. The usual solution to situations of this type is the provision of a breath actuated switch. Many of the known breath actuated switches require a continual application of a suction force or a positive pressure force by continual blowing to maintain an associated switch in a closed circuit condition.

Accordingly it is a primary object of this invention to provide a fluid actuated switch that remains positively engaged pending reactuation.

It is a further object of this invention to provide a fluid actuated switch that is selectively adjustable regulating the fluid force required to actuate the switch.

A still further object of this invention is the provision of a fluid actuated switch mounted within a fluid receiving member directing the fluid to either side of a vane actuating the switch.

Other objects and features of the present invention will further become apparent hereinafter with reference to the accompanying drawing and detailed description of the invention.

SUMMARY OF THE INVENTION

To achieve the foregoing objects in accordance with the purposes of this invention, as embodied and broadly described herein, the subject fluid actuated switch comprises a fluid receiver which includes two spaced side walls and a base member defining a channel, a stationary electrical switch contact positioned adjacent each of the side walls within the channel, a fluid actuated vane movable between the side walls in the channel in response to fluid directed by the side walls, a movable switch contact actuated by the vane selectively engaging the stationary contacts closing a first electrical circuit while opening a second electrical circuit, and means adjustably holding the vane consisting of a magnet positioned adjacent each of the side walls adjustably holding the movable switch contact closed with either of the stationary switch contacts.

BRIEF DESCRIPTION OF THE DRAWING

FIG. 1 is a perspective view of the fluid actuated switch of the invention.

FIG. 2 is a plan view of the fluid actuated switch illustrated in FIG. 1 taken from a perspective looking into the channel indicated by arrow 23 in FIG. 1.

DESCRIPTION OF THE PREFERRED EMBODIMENT

Reference will now be made in detail to the present preferred embodiment of the invention, an example of which is illustrated in the accompanying drawings.

With reference to FIGS. 1 and 2, the fluid actuated switch in accordance with this invention includes a fluid receiving member 10 having a base 12 with parallel side walls 14 and 16 and diverging side walls 18 and 20 secured thereon. The diverging side walls 18 and 20 are closed with an end wall 22. The side walls 14, 16, 18 and 20 define a fluid conducting channel illustrated generally by arrow 23. While the channel 23 is illustrated open from the top, it could be formed with a cover member. An arm 24 having a vane 26 secured thereto is pivotally connected in a conventional manner at 28 on the base 12. A common wire 30 composed of electrically conductive material is electrically connected to arm 24 for a purpose later to be described. The arm 24 also has bendable tabs 25 positioned at predetermined locations upon the arm.

Stationary electrical contact bars 32 and 34 are secured to the base 12 within the fluid receiving member 10. The bars 32 and 34, respectively, contain notches 36 and 38 and are electrically isolated by a space 40. A wire 42 is connected to bar 32 while a wire 44 is connected to bar 34.

Permanent magnets 46 and 48 are attached to contact bars 32 and 34, respectively, or to base 12 of the fluid receiving member, or to both at predetermined locations. The arm 24 moves between the magnets 46 and 48 in a oscillating manner in notches 36 and 38 as the arm 24 pivots about connection 28. To prevent vane 26 from being displaced too far to one side of the device which could render difficult the fluid actuation of the switch, the movement of arm 24 can be limited by engagement of arm 24 with ends 36A and 38A of notches 36 and 38, respectively, or by engagement of tabs 25 with either of the magnets 46 and 48 (not illustrated). The arm 24 moves across the top of bars 32 and 34 in the notches 36 and 38 completing respective circuits through wires 30 and 42 or wires 30 and 44. The arm 24 is electrically conductive and can be of a conductive material having characteristics permitting it to be continuously biased into sliding engagement with the top surfaces of the bars 32 and 34 within the notches. The crucial requirement is a connection completing a circuit through the arm and the respective bar.

While it is appreciated that the subject switch has many applications and can readily be used in any environment so as to be responsive to a particular flowing fluid, one area of particular use is that of a breath actuated switch. In this particular application area, the operator blows breath into the open end of the fluid receiving member 10 defined by side walls 14 and 16. When the vane is positioned toward the right, as shown in the drawing, the operator blows breath toward the side walls 16 and 20 which reflect the air back toward the vane 26 moving it and arm 24 to the left until the arm engages the end of notch 36 or until one of the tabs 25 engages magnet 46.

It can readily be seen that the circuit through wires 30 and 44 is opened and the circuit through wires 30 and 42 is rapidly closed as the arm 24 moves across space 40 separating the bars 32 and 34. Obviously, movement of the vane 26 to the right opening the circuit through the wires 30 and 42 and closing the circuit through wires 30 and 44 is accomplished by blowing breath against side walls 14 and 18.

The magnetic force holding the arm 24 and vane 26 in either the right or left circuit closing positions is regulated by bending tabs 25. The distance between the tabs 25 and the magnets 46 and 48 determines the holding ability of the magnets. The strength of the magnets and the length of the tabs can be matched to provide desired forces. The notches 36 and 38 can be of sufficient length to permit use of a wide range of holding forces. It is particularly significant that utilization of the tabs 25 in conjunction with the magnets 46 and 48 permit the holding force to be precisely regulated so that a slight change in breath is effective to move the vane and the arm 24 opening the first circuit and rapidly closing the second circuit. The fine tuning of the holding force while providing for a positive engagement in a circuit closed position are significant features of this invention.

It will be apparent to those skilled in the art that various modifications and variations can be made in the components of the subject fluid actuated switch without departing from the scope or spirit of the invention. In particular, any suitable electrical switching mechanism could be substituted for the bar conductors so that a mechanical or other type of switching mechanisms could be actuated by movement of the arm 24 in response to fluid applied to the vane 26 without departing from the scope of this invention.

What is claimed is:

1. A fluid actuated switch comprising fluid receiving means having two spaced fluid directing side walls forming a channel, a fluid actuated vane movable between said side walls in said channel in response to fluid directed by said side walls, movable switch contact means connected to said vane, electrically conductive stationary contact means adjacent each of said side walls within said channel for selective engagement with said vane, said movable switch contact means closing a first electrical circuit and opening a second electrical circuit when said vane is actuated from one side to the other side of said channel and means adjustably holding said vane and said movable switch contact means into contact with either one of said stationary contact means, said adjustable holding means comprising a permanent magnet mounted adjacent each of said stationary contact means in said channel and bendable tabs on said moveable contact means engaging by magnetic force the appropriate said magnet.

2. A fluid actuated switch as described in claim 1 wherein said vane is secured to an electrically conductive arm pivotally mounted within said channel, said conductive arm being the movable switch contact.

3. A fluid actuated switch as described in claim 1 wherein said stationary contacts are spaced electrically conductive bars isolated from each other and mounted within said channel for engagement by said movable switch contact.

4. A fluid actuated switch as described in claim 1 wherein said vane is secured to an electrically conductive switch arm pivotally mounted within said channel, said electrically conductive stationary contact means being electrically conductive bars, said arm being selectively biased by said magnetic force between said magnets and their respective bendable tabs into sliding engagement with said bars for closing a circuit through one bar and opening a circuit through the other when said vane is moved in said channel.

5. A fluid actuated switch as described in claim 4 wherein said electrically conductive bars each contain a notch adjacent a space between them and said permanent magnets are attached to each bar at predetermined positions so that said movable switch arm opens one circuit and closes another as it moves from one said notch to the other said notch across said space between said bars.

6. A fluid actuated switch as described in claim 1 wherein said bendable tabs extend substantially laterally of said movable switch contact means for engagement by magnetic force with said magnets so that the distance between said movable switch contact means and said magnets can be varied adjusting the holding force of said magnets.

7. A fluid actuated switch as described in claim 1 further comprising stop means for limiting the side displacement of said movable contact means and said connected vane.

8. A fluid actuated switch as described in claim 7 wherein each of said electrically conductive stationary contact means has a notch with an end and said stop means are said ends, said side displacement being limited by the physical contact of said movable contact means with either of said notch ends.

9. A fluid actuated switch as described in claim 8 wherein said stop means are said permanent magnets and their associated bendable tabs, said side displacement being limited by the physical contact of said permanent magnet with said tabs.

* * * * *